US010208549B2

(12) United States Patent
Haugland et al.

(10) Patent No.: US 10,208,549 B2
(45) Date of Patent: Feb. 19, 2019

(54) ACTIVATING TOOL FOR DISPLACING OF A COMPONENT IN A WELL TUBE AND METHOD FOR ADJUSTING THE ACTIVATING TOOL

(71) Applicant: Qinterra Technologies AS, Stavanger (NO)

(72) Inventors: Lasse Haugland, Bryne (NO); Arne Motland, Stavanger (NO)

(73) Assignee: Qinterra Technologies AS, Stavanger (NO)

( * ) Notice: Subject to any disclaimer, the term of this patent is extended or adjusted under 35 U.S.C. 154(b) by 327 days.

(21) Appl. No.: 15/038,669

(22) PCT Filed: Nov. 20, 2014

(86) PCT No.: PCT/NO2014/050218

§ 371 (c)(1),
(2) Date: May 23, 2016

(87) PCT Pub. No.: WO2015/076679

PCT Pub. Date: May 28, 2015

(65) Prior Publication Data

US 2016/0298402 A1 Oct. 13, 2016

(30) Foreign Application Priority Data

Nov. 21, 2013 (NO) ..... 20131557

(51) Int. Cl.
*E21B 23/00* (2006.01)
*E21B 31/20* (2006.01)
(Continued)

(52) U.S. Cl.
CPC ..... *E21B 23/00* (2013.01); *E21B 31/20* (2013.01); *E21B 34/14* (2013.01); *E21B 47/12* (2013.01)

(58) Field of Classification Search
None
See application file for complete search history.

(56) References Cited

U.S. PATENT DOCUMENTS 2,747,673 A * 5/1956 Lawrence ..... E21B 23/04 166/120
2,984,302 A * 5/1961 Church ..... E21B 23/04 166/120

(Continued)

FOREIGN PATENT DOCUMENTS

EP 0834643 A2 4/1998
WO 2010062186 6/2010
WO 2010114383 10/2010

*Primary Examiner* — Shane Bomar
(74) *Attorney, Agent, or Firm* — Gable Gotwals

(57) ABSTRACT

This invention relates to an activating tool (1) for connecting to and displacing a component (40) in a well tube (4), activating tool (1) includes a driving device (8) axially displaced in two axial directions; a sleeve-shaped release element (14) with an annular end portion (52); a gripper holder (20) arranged axially displaceable in release element (14) and displaced by driving device (8); axially longitudinal recesses (24) in gripper holder (20); at least two radially displaceable gripping elements (26) spring-biased in a radial outward direction, positioned in respective recesses (24) and complementarily fitting respective cut-outs (42) in the component (40), and each gripping element (26) has a slanted rear portion (48); gripping elements (26) retracted into release element (14) in passive positions of gripping elements (26), and gripping elements (26), at least partially, displaced out of release element (14) in active positions of gripping elements (26) so end portion (52) hits slanted rear portions (48) of gripping elements (26) when gripper holder (20) is pulled inwards in release element (14), gripping elements (26) optionally switched between active and pas- (Continued)

sive positions. A method for changing gripping element (26) in the activating tool (1) is described.

12 Claims, 4 Drawing Sheets

(51) Int. Cl.
*E21B 34/14* (2006.01)
*E21B 47/12* (2012.01)

(56) References Cited

U.S. PATENT DOCUMENTS

| | | | | |
|---|---|---|---|---|
| 3,335,802 | A | 8/1967 | Seyffert, III | |
| 3,702,634 | A | 11/1972 | Anderson et al. | |
| 4,928,772 | A | 5/1990 | Hopmann | |
| 5,242,201 | A * | 9/1993 | Beeman | E21B 23/04 294/86.15 |
| 6,095,583 | A | 8/2000 | Beeman et al. | |
| 2003/0150612 | A1 | 8/2003 | McGarian et al. | |
| 2011/0220346 | A1 * | 9/2011 | Osaland | E21B 23/00 166/216 |
| 2012/0090832 | A9 * | 4/2012 | Osaland | E21B 23/00 166/216 |
| 2016/0115757 | A1 * | 4/2016 | Yang | E21B 31/20 166/75.11 |

* cited by examiner

V-V

ACTIVATING TOOL FOR DISPLACING OF A COMPONENT IN A WELL TUBE AND METHOD FOR ADJUSTING THE ACTIVATING TOOL

CROSS-REFERENCE TO RELATED APPLICATIONS

This United States application is the National Phase of PCT Application No. PCT/NO2014/050218 filed on 20 Nov. 2014, which claims priority to Norwegian Patent Application No. 20131557 filed 21 Nov. 2013, each of which is incorporated herein by reference.

This invention relates to a device for connecting to and displacing a component in a well tube. More particularly, it relates to a device for connecting to and displacing a component in a well tube, the device including an actuator with a driving device, and the activating tool further including at least two gripping elements spring-biased in a radial outward direction, which complementarily fit gripping cut-outs in the component and which are arranged to be released by a release element.

During work in a borehole, for example in a petroleum well, it is often necessary to be able to displace a component which is in the well. The component may typically be an actuating mechanism for a valve.

Actuating mechanisms of this kind typically comprise a concentric sleeve in a well tube, wherein gripping cut-outs have been arranged in the sleeve wall for the connection of actuating equipment, and wherein the actuating equipment is arranged to displace the actuating mechanism. Prior-art actuating equipment is adapted to the internal diameter of the actuating mechanism and provided with gripping elements that fit the gripping cut-outs.

For various well-engineering reasons, restrictions may have been arranged upstream of the valve in the well tube. The restriction may be formed with a substantially smaller internal diameter than the well tube. For example, in a well tube with a 118 mm internal diameter, there may be a restriction that has a 71 mm internal diameter. Such restrictions limit the access to actuating mechanisms located further inside the well.

Over time, deposits of particulate material will settle on components in the well tube. Such deposits may also settle on gripping cut-outs and possible guide cut-outs in the actuating mechanism for a valve. The deposits may prevent the gripping elements of the actuating equipment from engaging with the gripping cut-outs and guide cut-outs of the actuating mechanism. The actuating equipment may overcome this problem by pressing the gripping element with a radially directed force sufficient for the deposits to be pushed out of the gripping cut-outs and guide cut-outs or, alternatively, for the deposits to be compressed so that a functionally reliable contact between the gripping element and the actuating mechanism is achieved.

Over time, the actuating mechanism may become stiffer to displace along the centre axis of the well tube. If the gripping cut-outs are not pressed with sufficient radial force while the actuating mechanism is being displaced, the gripping elements may be pressed radially inwards towards the centre axis of the well tube and lose contact with the gripping cut-outs. The patent publication WO 2010/062186 discloses an activating tool which is arranged to be displaced through a restriction and in which the gripping elements are mounted on relatively long leaf springs. It has been found that the device according to the patent publication WO 2010/062186 is conditional on a centric positioning in its working position in order to achieve a reliable function. It has further been found that the leaf springs do not provide a sufficient radial push force on the gripping elements for them to be functionally reliable when there are deposits in the gripping cut-outs and guide cut-outs in the actuating mechanism.

The patent publication WO 2010/114383 discloses a tool for use in a well tube. The tool is provided with at least one gripping element which is pressed radially outwards by springs directed radially between the bottom side of the gripping element and an inner cylinder. An outer housing holds the gripping element in a passive position. The gripping element takes an active position by the outer housing being displaced relative to the inner cylinder by a cable extending from the tool to the surface being pulled. A spring working axially keeps the housing in the passive position. The spring is compressed as the tool is activated. A spring-loaded locking bolt locks the housing in the active position so that the housing will not be forced back into the passive position by the axially working spring. In its active position, the spring-loaded gripping element is kept in position in a cut-out in the inner cylinder by a first shoulder resting against a shoulder in the inner cylinder and by an opposite second shoulder resting against the internal, lower edge portion of the housing. After the tool is activated, the tool must be moved out of the well tube for it to be deactivated, as the locking of the housing by the locking bolts cannot be released when the tool is in the well tube, and because the lower edge portion of the housing will butt against a stepping in the gripping element formed by the second shoulder.

It is desirable that the gripping elements can be changed in a simple way. A first gripping element is arranged to displace the actuating mechanism in a first axial direction. A second gripping element is arranged to displace the actuating mechanism in a second axial direction. It is therefore advantageous that the activation tool can be provided with a first gripping element or a second gripping element in a quick and simple manner.

The invention has for its object to remedy or reduce at least one of the drawbacks of the prior art or at least provide a useful alternative to the prior art.

The object is achieved through the features that are specified in the description below and in the claims that follow.

The invention is defined by the independent claims. The dependent claims define advantageous embodiments of the invention.

In a first aspect, the invention more specifically relates to an activating tool for connecting to and displacing a component in a well tube, the activating tool including:

- a driving device which may axially be displaced in two axial directions;
- a sleeve-shaped release element provided with an annular end portion;
- a gripper holder which is arranged in an axially displaceable manner in the release element and is displaced by the driving device;
- axially longitudinal recesses in the gripper holder;
- at least two radially displaceable gripping elements spring-biased in a radial outward direction, positioned in respective recesses and complementarily fitting respective cut-outs in the component, and each gripping element being provided with a slanted rear portion;

so that the gripping elements are retracted into the release element in the passive positions of the gripping elements, and the gripping elements are, at least partially, displaced out of the release element in the active positions of the gripping elements, characterized by the end portion hitting the slanted rear portions of the gripping elements when the gripper holder is pulled inwards in the release element, so that the gripping elements may optionally be switched between taking an active position and a passive position.

By the gripper holder being able to be displaced repeatedly into and out of the release element in one and the same operation in the well tube, it is achieved that the activating tool may optionally displace a component or passively pass a component in the well tube.

On its inside in its annular end portion, the release element may be provided with a surface directed axially; and between a gripping hook and the slanted rear portion, the gripping element may be provided with a holding surface directed axially; so that the surface directed axially may rest against the holding surface in the passive position of the gripping element.

The gripping element may be provided with a first shoulder and a second opposite shoulder. The recess may be provided with a detachable stop, and the detachable stop may be provided with a first projection projecting over the first shoulder of the gripping element when the gripping element is positioned in the recess. The stop may constitute a holder for the first shoulder. A locating guide may be provided with a second projection projecting over the second shoulder of the gripping element when the gripping element is positioned in the recess. The locating guide may constitute a holder for the second shoulder.

The release element may be connected to the housing of the driving device, and the gripper holder may be connected to the working element of the driving device.

The activating tool may be designed to have a sensor.

In a second aspect, the invention more specifically relates to a method for fitting a gripping element in a gripper holder in an activating tool as described above, the gripper holder including a recess and the gripping element including two opposite shoulders, the method including the steps:

a) detaching a holder for a projection projecting in the recess, so that the projection can be removed from the recess;

b) positioning the gripping element in the recess so that one of the shoulders is moved in under one of the projections; and c) fixing the holder so that the projection projects over the opposite shoulder from the shoulder mentioned in step b).

Step a) may comprise detaching a stop, and step c) may comprise attaching the stop. Step a) may, as an alternative, comprise detaching a detachable locating guide from the free end portion of the gripper holder, and step c) may comprise attaching the locating guide to the free end portion of the gripper holder. According to the alternative mentioned, steps a) and c) may, respectively, comprise detaching and attaching the locating guide from/to the gripper holder with at least one bolt.

The method may further include the steps:

$d_1$) repeating step a);

$e_1$) displacing the gripping element out of the recess;

$f_1$) providing an alternative gripping element; and $e_1$) repeating steps b)-c).

The method may further include the steps:

$d_2$) repeating step a);

$e_2$) displacing the gripping element out of the recess;

$f_2$) turning the gripping element 180°; and $e_2$) repeating steps b)-c).

In what follows, an example of a preferred embodiment is described, which is visualized in the accompanying drawings, in which.

Figure 1:
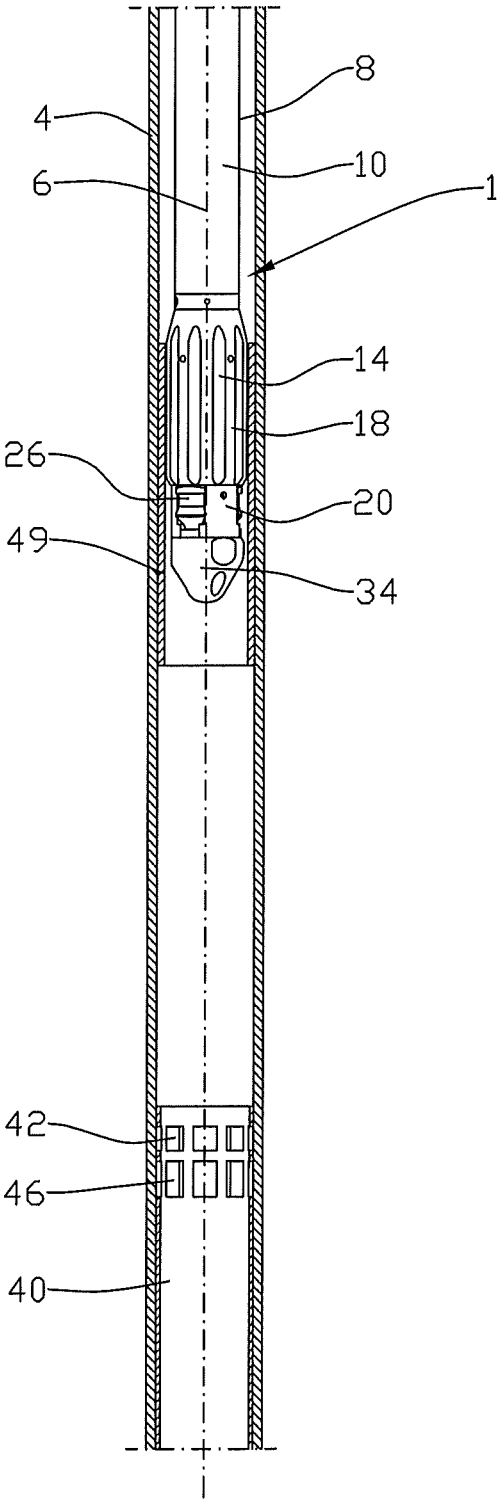
FIG. 1 shows an activating tool according to the invention, the activating tool being displaced in a restriction in a well tube.

In the drawings, the reference numeral 1 indicates an activating tool which is connected to a wireline tractor 2 and is in a well tube 4. The well tube 4 has a centre axis 6.

The activating tool 1 includes a driving device 8 which is often termed a "stroker". The driving device 8 may comprise an electric or hydraulic power engine which includes a sleeve-shaped housing 10, and which is arranged, in a manner known per se, to displace a centric working element 12 relative to the housing 10 in a direction along the centre axis 6 of the well tube 4, see FIGS. 4 and 5.

A sleeve-shaped release element 14 is connected at one end portion to the housing 10 by means of a threaded sleeve 16. The release element 14 is externally provided with a number of axially longitudinal ridges 18 distributed around the release element 14, which are arranged to facilitate the displacement of the activating tool 1 in the well tube 4.

A gripper holder 20 which is displaceably arranged in the release element 14 is connected to the working element 12 by means of a threaded connection 22. The gripper holder 20 is provided with axially longitudinal recesses 24. In the figures, three recesses 24 are shown, but the number of recesses 24 may be two or more than three. In each recess 24, a gripping element 26 is positioned.

The gripping elements 26 are tensioned outwards by means of a number of springs 28 located between the recess 24 and their respective gripping element 26.

A locating guide 34 is attached to the free end portion of the gripper holder 20 by means of bolts 36.

Figure 4:
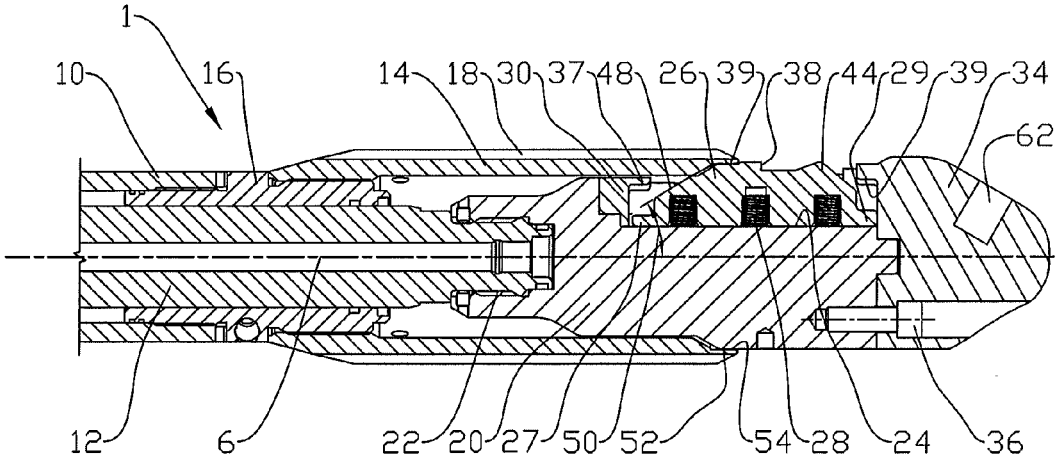
FIG. 4 shows an axial section of the activating tool on a larger scale, in which the gripping elements of the activating tool are in their retracted passive positions.
Figure 5:
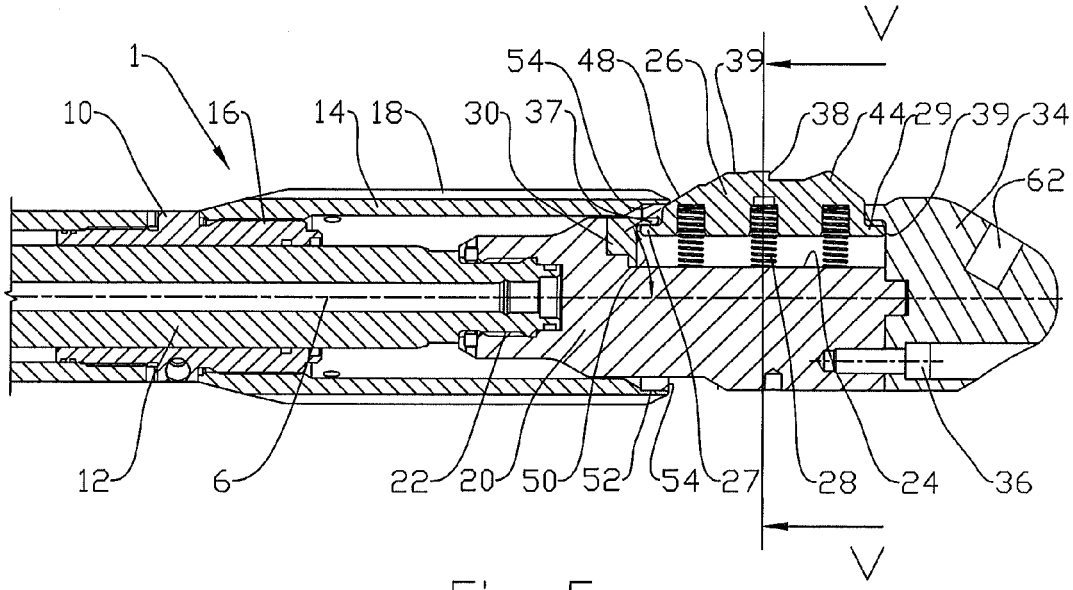
FIG. 5 shows the same as FIG. 4, but the gripping elements of the activating tool are in their active positions.
Figure 6:
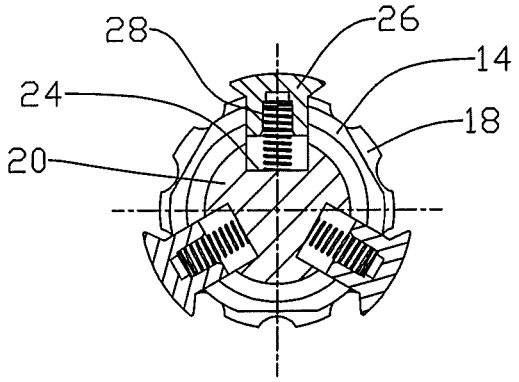
FIG. 6 shows a section V-V of FIG. 5.

The gripping element 26 is provided with a first shoulder 27 and an opposite second shoulder 29. A stop 30 is detachably attached with one or more screws (not shown) in one end portion of the recess 24 that faces away from the locating guide 34. The stop 30 is provided with a first projection 37 projecting over the first shoulder 27 of the gripping element 26. The stop 30 constitutes a holder for the projection 37. The locating guide 34 is provided with a second projection 39 projecting over the second shoulder 29 of the gripping element 26 as shown in FIGS. 4 and 5. The locating guide 34 constitutes a holder for the projection 39. The gripping element 26 is prevented from being displaceable all the way out of the recess 24 by the first shoulder 27 and the second shoulder 29 resting against the first projection 37 and the second projection 39, respectively, when the gripping element 26 is in its active position as shown in FIG. 5.

The gripping elements 26 are externally provided with a gripping hook 38 complementarily fitting the gripping cutouts 42 of a component 40, here in the form of an actuating mechanism. The gripping elements 26 are also provided with a guide bulb 44 which is arranged to prevent the gripping elements 26 from unintentionally engaging during displacement in the well tube 4. The guide bulb 44 must be placed in a guide cut-out 46 in the component 40 for the gripping hook 38 to engage with the gripping cut-out 42.

The gripping element 26 is provided with a slanted rear portion 48 which has an angle 50 to the centre axis 6 of less than 90 degrees and preferably less than 45 degrees.

When the working element 12 pulls the gripper holder 20 inwards in the release element 14, the slanted rear portion 48 of the gripping element 26 hits the annular end portion 52 of the release element 14. The gripping element 26 is thereby forced inwards towards the centre axis 6 against the force of the springs 28 and into its passive position, see FIG. 4. On its inside, the annular end portion 52 is provided with a surface 54 directed axially. Between the gripping hook 38 and the rear portion 48, the gripping element 26 is provided with a holding surface 39 directed axially. The surface 54 presses against the holding surface 39 so that the gripping element 26 is forced inwards towards the centre axis 6 at both the front edge and the rear edge of the gripping element 26 without the gripping hook 38 having been moved into the release element 14. The driving device 8 is arranged to displace the centric working element 12 with great force. Thereby the radial force exerted by the springs 28 on the gripping element 26 is overcome.

Figure 2:
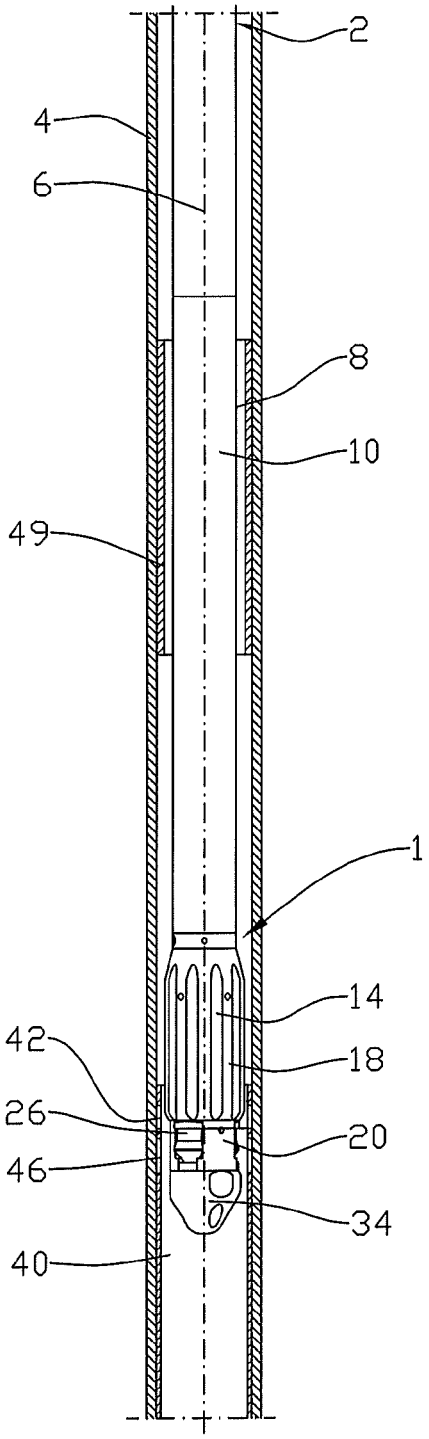
FIG. 2 shows the activating tool, the gripping elements of the activating tool being in position for engaging with a component.
Figure 3:
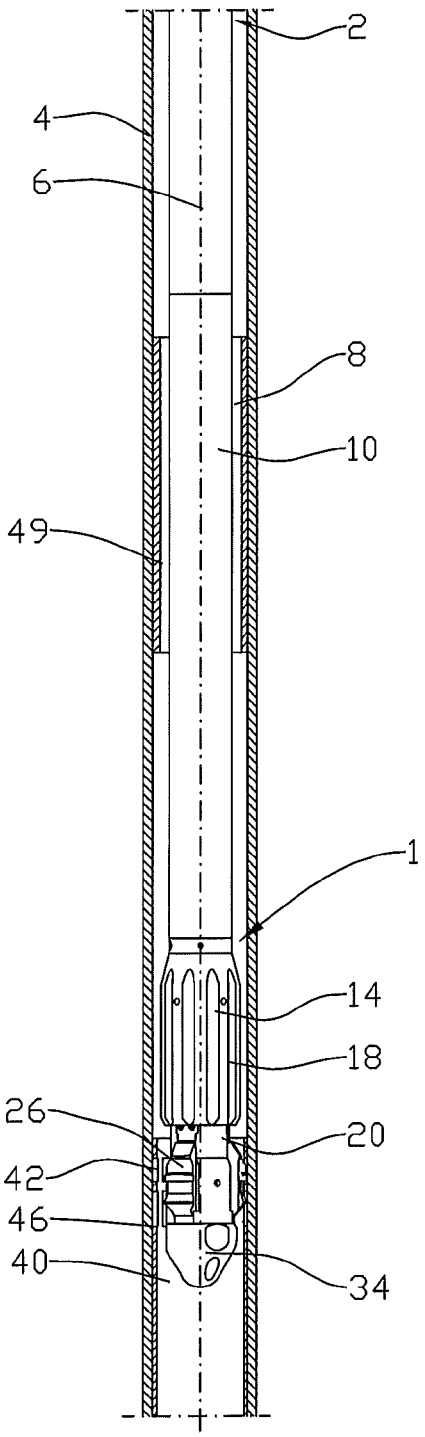
FIG. 3 shows the activating tool after the component has been displaced and the gripping elements are in their active positions.

When the activating tool 1 has been displaced through a restriction 49 and placed in position at the component 40, as is shown in FIG. 2, the gripping elements 26 may be activated into engagement with the component 40. Then the component 40 is displaced to the desired position relative to the well tube 4. The springs 28 exert a great radial force on the gripping element 26 so that deposits, if any, in the gripping cut-outs 42 and possible guide cut-outs 46 are pushed out of the gripping cut-outs 42 and possible guide cut-outs 46 by means of the gripping hooks 38 and the guide bulbs 44, respectively. Deposits, if any, may alternatively be compressed in the gripping cut-outs 42 and guide cut-outs 46 by the gripping hooks 38 and the guide bulbs 44, respectively. It is thereby ensured that the gripping element 26 achieves a good engagement with the component 40. The springs 28 may also be chosen to be such that they exert a sufficient radial force on the gripping elements 26, so that the gripping element 26 does not disengage from the component 40 if the component 40 is heavy to displace in an axial direction along the centre axis 6 of the well tube. The driving device 8 works via the working element 12 directly on the gripping element 26 and may thereby displace the component 40 with great force.

After the component 40 is displaced, the gripping elements 26 may be deactivated by the driving device 8, via the working element 12, pulling the gripper holder 20 into the release element 14. The activating tool 1 may be pulled out of the well tube through the restriction 49. In an alternative, the activating tool 1 may be displaced further into the well tube 4 to activate another component 40. In its passive position, the activates ing tool 1 may also optionally be displaced past a component 40.

The design of the release element 14 has the effect of the gripping elements 26 being kept away from the wall of the well tube 4 during displacement in the well tube 4.

The design of the activating tool 1 is such that it need not be in a centric position in the well tube 4 to be able to engage with the component 40.

The invention makes it possible to turn or change gripping elements 26 in the gripper holder 20 in a simple and quick way. The centric working element 12 is detached from the driving device 8. The working element 12 is displaced relative to the release element 14 so that the entire recess 24 of the gripper holder 20 extends outside the end portion 52 of the release element 14. The stop 30 is detached and removed from the recess 24. Then the gripping element 26 is flipped out by turning it around the second shoulder 29 which is resting against the projection 39. The gripping element 26 may be turned 180° and positioned in the recess 24 by moving the first shoulder 27 in under the second projection 39. Then the stop 30 is attached with its screws. The first projection 37 of the stop 30 rests against the second shoulder 29 of the gripping element 26 and the stop 30. Because of the springs 28, the gripping element 26 will press against the first projection 27. When being tightened, the screws will press the stop 30 down into the recess 24 against the force of the springs 28. Different gripping elements 26 are changed by the same method.

The gripping element 26 may also be turned or changed by an alternative method being followed. The locating guide 34 is detached completely from the gripper holder 20 by loosening and removing the bolts 36 when the gripping element 26 is in its active position. The gripping element 26 is displaced axially out of the recess 24 in the direction of the free end portion of the gripper holder 20. The gripping element 26 may be turned 180° or a gripping element 26 of an alternative design is then moved axially into the recess 24 from the free end portion of the gripper holder 20. The locating guide 34 is attached to the gripper holder 20 with the bolts 36.

Further, an instrument holder 62 has been made, which is arranged in the locating guide 34 here, to enable the positioning of various sensors not shown in the activating tool 1. Wire connections necessary per se are not shown either.

In an alternative embodiment (not shown), the locating guide 34 may be provided with a threaded portion at its free end portion, for the connection of a logging string of a type known per se. The threaded portion may be centred. At one end portion, the logging string is provided with a threaded portion for connection to the locating guide 34, and the logging string is provided with logging-string components or sensors of types known per se for acquiring data.

It should be noted that all the above-mentioned embodiments illustrate rather than limit the invention, and persons skilled in the art may form many alternative embodiments without departing from the scope of the dependent claims. In the claims, any reference numerals in brackets shall not be construed as limiting the claim. The use of the verb "to comprise" and its various forms, does not exclude the presence of elements or steps that are not mentioned in the claims. The indefinite articles "a" or "an" in front of an element does not exclude the presence of more such elements. The mere fact that certain measures are recited in mutually different dependent claims does not indicate that a combination of these measures cannot be used to advantage.

The invention claimed is:

1. An activating tool (1) for passing a restriction (49) in a well tube (4) and connecting to and displacing a component (40) in the well tube (4), the activating tool (1) comprising:

a driving device (8) comprising an electrical or hydraulic power engine;

the driving device (8) comprising a housing (10) and a centric working element (12) displaceable axially in two axial directions relative to the housing (10) along a centre axis of the well tube (4);

a sleeve-shaped release element (14) connected to the housing (10) and provided with an annular end portion (52);

a gripper holder (20) connected to the working element (12) and which is arranged in an axially displaceable manner in the release element (14) and is displaced by the driving device (8);

axially longitudinal recesses (24) in the gripper holder (20);

at least two radially displaceable gripping elements (26) spring-biased in a radial outward direction, positioned in respective recesses (24) and complementarily fitting respective cut-outs (42) in the component (40), and each gripping element (26) being provided with a slanted rear portion (48);

so that the gripping elements (26) are retracted into the release element (14) in passive positions of the gripping elements (26), and the gripping elements (26) are, at least partially, displaced out of the release element (14) in active positions of the gripping elements (26) the end portion (52) hits the slanted rear portions (48) of the gripping elements (26) when the gripper holder (20) is pulled inwards in the release element (14), so that the gripping elements (26) are switched between taking the active positions or the passive positions.

2. The activating tool (1) according to claim 1, wherein, on its inside in its annular end portion (52), the release element (14) is provided with a surface (54) directed axially; and wherein, between a gripping hook (38) and the slanted rear portion (48), the gripping element (26) is provided with a holding surface (39) directed axially; and wherein the surface (54) rests against the holding surface (39) in the passive position of the gripping element (26).

3. The activating tool (1) according to claim 1, wherein the gripping element (26) is provided with a first shoulder (27) and a second opposite shoulder (29).

4. The activating tool (1) according to claim 1, wherein the recess (24) is provided with a detachable stop (30), and wherein the detachable stop (30) is provided with a first projection (37) projecting over a first shoulder (27) of the gripping element (26) when the gripping element (26) is positioned in the recess (24).

5. The activating tool (1) according to claim 1, wherein a detachable locating guide (34) is provided with a projection (39) projecting over a second shoulder (29) of the gripping element (26) when the gripping element (26) is positioned in the recess (24).

6. The activating tool (1) according to claim 1, wherein the release element (14) is externally provided with a number of axially longitudinal ridges (18) distributed around the release element (14).

7. A method for fitting the gripping element (26) in the gripper holder (20) of the activating tool (1) according to claim 1, the gripper holder (20) including the recess (24) and the gripping element (26) including two opposite shoulders (27, 29), said method comprising the following steps:

a) detaching a holder (30; 34) for a projection (37, 39) extending in the recess (24), so that the projection (37, 39) can be removed from the recess (24);

b) positioning the gripping element (26) in the recess (24) so that one of the shoulders (27, 29) is moved in under one of the projections (37, 39); and c) fixing the holder (30; 34) so that the projection (37, 39) projects over the opposite shoulder (27, 29) from the shoulder (27, 29) mentioned in step b).

8. The method according to claim 7, wherein step a) comprises detaching a stop (30) and step c) comprises attaching the stop (30).

9. The method according to claim 7, wherein step a) comprises detaching a detachable locating guide (34) from a free end portion of the gripper holder (20) and step c) comprises attaching the locating guide (34) to the free end portion of the gripper holder.

10. The method according to claim 9, wherein steps a) and c) comprise, respectively, detaching and attaching the locating guide (34) from/to the gripper holder (20) with at least one bolt (36).

11. The method according to claim 7, wherein the method further includes the steps:

repeating step a);

displacing the gripping element (26) out of the recess (24);

providing an alternative gripping element (26); and repeating steps b)-c).

12. The method according to claim 7, wherein the method further includes the steps:

repeating step a);

displacing the gripping element (26) out of the recess (24);

turning the gripping element (26) 180°; and repeating steps b)-c).

* * * * *